US005722261A

United States Patent [19]

Lehrer

[11] Patent Number: 5,722,261

[45] Date of Patent: Mar. 3, 1998

[54] TOROUS RING GEMSTONE AND METHOD FOR MAKING SAME

[76] Inventor: Glenn W. Lehrer, P.O. Box 15038, San Rafael, Calif. 94915

[21] Appl. No.: 778,208

[22] Filed: Dec. 30, 1996

Related U.S. Application Data

[60] Provisional application No. 60/030,596, Nov. 13, 1996.

[51] Int. Cl.[6] ..... A44C 17/00

[52] U.S. Cl. ..... 63/32

[58] Field of Search ..... 63/32, 35, 36, 63/28, 1.16, 26, 29.1, 30, 31, 12, 13, 3, 15, 27; 451/41, 28, 43, 54, 57, 58; 428/15, 7; D11/89, 90

[56] References Cited

U.S. PATENT DOCUMENTS

| | | | |
|---|---|---|---|
| 2,261,958 | 11/1941 | Burri | 63/32 |
| 2,270,210 | 1/1942 | Barbieri | 63/32 |
| 2,270,270 | 1/1942 | Clare | 63/32 |
| 2,354,067 | 7/1944 | Schmalz | 63/32 |
| 2,447,407 | 8/1948 | Grain | 63/32 |
| 4,708,001 | 11/1987 | Alburger | 63/32 |
| 5,090,216 | 2/1992 | Waugh | 63/32 |
| 5,454,234 | 10/1995 | Karmeli | 63/32 X |

*Primary Examiner*—David M. Purol
*Attorney, Agent, or Firm*—Steven Mitchell

[57] ABSTRACT

A method for cutting and faceting a gemstone to provide a torus ring shape and gemstone provided thereby. A complete or partial torus is generated having a hole bored in the center through the pavilion and the crown. The method works with various gemstone shapes including round, marquise, oval and cushion. In a round gemstone, a pair of parallel planes are lapped and a circular hole concentric with a vertical axis of the gemstone and perpendicular to the lapped planes is drilled through the gemstone crown and pavilion leaving a torus ring shape. Inside and outside pavilion faces are carved to the desired shapes. Outside and inside crown angles are cut or carved to the desired shape. The various surfaces are sanded and polished. If desired, another gemstone may be set into the center of the hole in the crown using goldsmithing and/or lapidary techniques.

20 Claims, 5 Drawing Sheets

TOROUS RING GEMSTONE AND METHOD FOR MAKING SAME

This application claims the benefit of U.S. Provisional Application No. 60/030,596, filed Nov. 13, 1996.

BACKGROUND OF THE INVENTION

This invention relates generally to the art of cutting and faceting gemstones, and more particularly, to an improvement in the cutting and finishing of the pavilion and crown areas of gemstone materials.

The art of cutting and faceting gemstones has become standardized to the extent that there are specific limitations as to the angles of facets with respect to a horizontal plane parallel to the girdle of any given cut design. This is particularly true of the pavilion of a given gemstone, because it is the pavilion and the facets thereof which provide the bulk of reflectivity or brilliance in the finished gem.

A faceted gemstone normally has three principal parts; the crown, or upper part of the gem; the girdle, which is a narrow band around the outer edge of the stone; and the pavilion, which is the bottom part of the stone. The pavilion usually has "main" facets which extend to a point known as the culet. These main facets must have an angle, relative to the girdle plane, which is greater than the "critical angle" of the gemstone material, that is if good brilliance of the finished gemstone is to be obtained.

The size of the finished gemstone is determined by the size (diameter) of the girdle, and other dimensions are usually stated as percentages of the girdle diameter. The crown, for example, usually has a flat polished area parallel to the girdle plane, known as the table, this table having a diameter of about 50% of the girdle diameter. In a conventionally-cut gemstone, having correct main angles, the total depth from table to culet is about 70% to 75% of the girdle diameter, and the pavilion depth, from culet to girdle plane, is about two thirds of the total stone depth, or about half the girdle diameter.

Facet designs are found in an almost infinite variety, where facets are disposed in various arrangements on the crown and pavilion. In a well-cut stone, the girdle is also faceted to match the pavilion and crown facets, but sometimes the girdle is left unfinished as a fine-grind circle. Stone shapes may range from triangular, through square, to multi-sided shapes, and even free-form non-symmetrical shapes. Multi-sided stones having more than four sides may be referred to as "round" stones, and various oval shapes may be considered as being varieties of round stones. In the case of ovals the diameter may be stated as the minimum, maximum, or average distance across the girdle, according to the preference of the cutter.

For the purpose of this specification, a typical round stone, known as a round brilliant, will be used as an illustration, however it will be understood that the invention may be applied to any selected gemstone shape, even though so-called "round" shapes may be preferred.

In modern gem-cutting practice, the proportions of a properly-cut gemstone are fairly well defined. As stated above, the depth of the pavilion is usually about 50% of the girdle diameter, and the height of the crown, above the girdle plane, is usually about 25% of the girdle diameter. These relative dimensions are determined mainly by the index of refraction of the particular gemstone material, and this also determines the minimum angle of the pavilion facets (relative to the girdle plane) which allows light entering the crown to be reflected from the pavilion facets. If the angle of the pavilion "mains" is too small, light will pass through these facets instead of being reflected, resulting in a "window" or a "fish-eye", and the finished stone will lack brilliance.

Obviously, a gemstone which is too shallow in the rough, and which is cut to excessively low main angles, will fail to reflect light properly, and will lack brilliance. In the past, there has been only one solution to the problem presented by a shallow stone, this being to reduce the size of the girdle diameter so as to permit cutting correct angles on crown and pavilion, that is if correct main angles are to be maintained. This may often result in a loss in stone size of as much as 75%, or more.

In U.S. Pat. No. 4,708,001 to Alburger, which disclosure is incorporated herein by reference, a faceted gem having a polished cone-shaped depression cut into the pavilion is disclosed. The cone is concentric with the vertical axis of the gemstone, and has an included angle at the cone apex of about 90°, and a base diameter equal to about 50% of the girdle diameter. The polished internal cone configuration of the pavilion permits a shallow stone to be cut to a maximum girdle diameter, such that the yield in stone size is increased as compared with the yield obtainable by cutting the pavilion in the conventional manner with correct main angles. While this patent provided an improvement over the prior art, it is limited to providing gems which are shallower in configuration but are still conventional in appearance. It would be desirable to provide a finished gem having a novel appearance while providing improved yield in the weight of the finished gem.

A desirable effect in working gemstones would be to have one gem mounted within another. Placing a hole in gem material has been done before, but not without sacrificing the full faceted brilliance of the gemstone. It would be desirable to provide a gemstone cut which takes full advantage of the brilliance achievable with conventional faceting of a single gem while allowing another gem to be set within a hole in the gemstone.

SUMMARY OF THE INVENTION

The gemstones of the invention are configured in the general shape of a torus ring. In an exemplary embodiment of the invention, a round gemstone includes a girdle in a girdle plane which is perpendicular to a central vertical axis of the gemstone. A crown extends above the girdle plane with a table at the top of the gemstone. The plane of the table is parallel to the girdle plane. An outside crown angle slopes from the periphery of the table to the girdle and may be faceted or have a smooth contour. A pavilion extends below the girdle and includes an outside pavilion face and an inside pavilion face. The pavilion faces may also be faceted or have a smooth contour. A center bored hole having an axis of the central vertical axis extends from the table to the inside pavilion face with an inside crown angle providing a bevel from the table to the center bored hole. The inside and outside pavilion faces extend downward and meet at a ring culet which lies in a plane parallel to the girdle plane. The angle of the outside pavilion face and inside pavilion face are selected to be greater than the critical angle for the gemstone material. With the gemstones of the invention, the need for much of the pavilion of conventional gemstones is eliminated allowing the use of gems with a much shallower depth. If desired, a smaller gemstone can be set within the center bored hole using goldsmithing and/or lapidary techniques. For the torus ring gemstone of the invention, the depth to diameter ratio can be as low as 22 to 38% providing a shallow gemstone which can sit lower to the wearer's body than conventional gemstone cuts and providing greater gem weight retention than such cuts.

In various alternative embodiments of the invention, the gemstone has one of the various fancy shapes such as oval, marquise, heart, pear, cushion, etc. It is preferred to use a round bored hole calibrated to the overall stone diameter with such shapes if the depth of the stone is sufficient. However, for shallow gemstone material, a hole outlining the outside girdle diameter can be used. For such cases, the inside pavilion angle that stretches toward narrow ends or corners of the profile may be cut shallower than the critical angle of reflection to allow the inside pavilion face to meet the outside pavilion face at the ring culet. However, as the inside pavilion face curves around towards the narrower diameter of the gemstone, the inside pavilion angle can be sloped back up to and above the critical angle of the gemstone material.

In another alternative embodiment of the invention the torus ring cut is cut into a section of a whole. Such sectioned cuts include for example three-quarters, nine-tenths, etc. Additionally, the sectioned cuts are not limited to round shapes but can be cut from any fancy cut gem profile such as oval, marquise, heart, pear, cushion, etc.

As an example of the benefit of the gemstone cut of the present invention, one can consider a 15.0 mm standard round brilliant gemstone. Such a gemstone requires an overall depth of 9.0 mm to achieve the preferred refractive brilliance. In contrast, a torus cut of the invention can achieve full refractive brilliance with a depth of no more than 3.3 to 5.7 mm (22–38%). An even shallower cut is possible with a larger diameter center bored hole. The ability to provide a full diameter shallow cut allows the gemstone to sit much lower to the body of the wearer and to achieve greater gemstone weight retention after cutting.

The method of the invention for producing gemstones starts with a synthetic or natural gemstone rough. Parallel planes are lapped to the gemstone rough and the centers of the lapped planes are marked. With a template of the appropriate shape, i.e., round, oval, marquise, cushion, etc., the girdle diameter is determined to provide maximum weight retention. Then, the diameter of the center bored hole is determined from the depth of the stone relative to the outside girdle diameter in order to achieve desired brilliance based on the critical angle for the gemstone material.

Once the outside diameter, inside diameter and overall depth have been determined for the lapped rough, the center bored hole is drilled. After the center bored hole is drilled, the gemstone rough is mounted to a facet head dop and the dop with the gemstone mounted thereon is itself mounted in a faceting machine and set to a 90 degree angle to the lapped parallel planes. The outside girdle is now formed to the chosen template shape using a corresponding cam attachment to a faceting or automated preforming machine. Once the girdle is complete, the outside pavilion face is cut on the curved round such as by faceting flat planes of assorted angles. In a preferred embodiment, the angle is cut on a curved single smooth round plane forming a portion of a cone surface. The inside pavilion face is next carved to the desired angle greater than the critical angle. The specific angle depends on the ratio of the girdle diameter to the inside diameter of the center bored hole and the depth of the stone. For example, if the depth of the gemstone is shallow and the ratio of the outside diameter to inside diameter is average, then the angle of the inside pavilion face (inside angle) will need to be close to the critical angle. On the other hand, if the stone is deep and/or the center hole diameter is relatively small, then the inside angle can be substantially greater than the critical angle. For fancy shape gemstones, the inside pavilion angle varies for different parts of the gem in order to meet the outside pavilion culet. For example, with a marquise cut, the angle on the sides along the length may be as great as about 55 to 70 degrees and only about 42 to 45 degrees towards the points of the marquise cut.

In a preferred embodiment, the inside and outside pavilion faces are carved with various negative cuts achieved using known gemstone carving techniques. The negative cuts of the pavilion faces are then sanded and taken to polish using conventional techniques for the given gemstone material. Once the negative cuts have been sanded and polished, the inside and outside pavilion faces are sanded and polished using the same techniques.

The gemstone is next reverse dopped with the crown up and the outside crown angle is cut. The inside crown angle is then cut to approximately 45 degrees. The inside girdle and inside crown angle are now sanded and polished. If any negative cuts have been made in the table, they are also sanded and polished. The table is checked to determine if it is parallel with the girdle plane and if not, it is lapped, sanded and polished. The finished gemstone is then removed from the dop.

It is therefore an object of the invention to provide a modified cut of a gemstone pavilion and crown so as to produce a finished gem in a torus ring shape.

It is another object of the invention to provide a gemstone within which another gem may be mounted.

It is still another object of the invention to provide a pavilion and crown cut which allows large gemstones to be cut to shallow depths.

It is a further object of the invention to provide a method of cutting and finishing a gemstone to provide a gemstone in the shape of a torus ring.

It is yet another object of the invention to provide a partial toroidal gemstone.

These and other objects of the invention will become apparent to those skilled in the art from a reading of the following specification, and an examination of the accompanying figures.

DETAILED DESCRIPTION OF THE INVENTION

Figure 1:
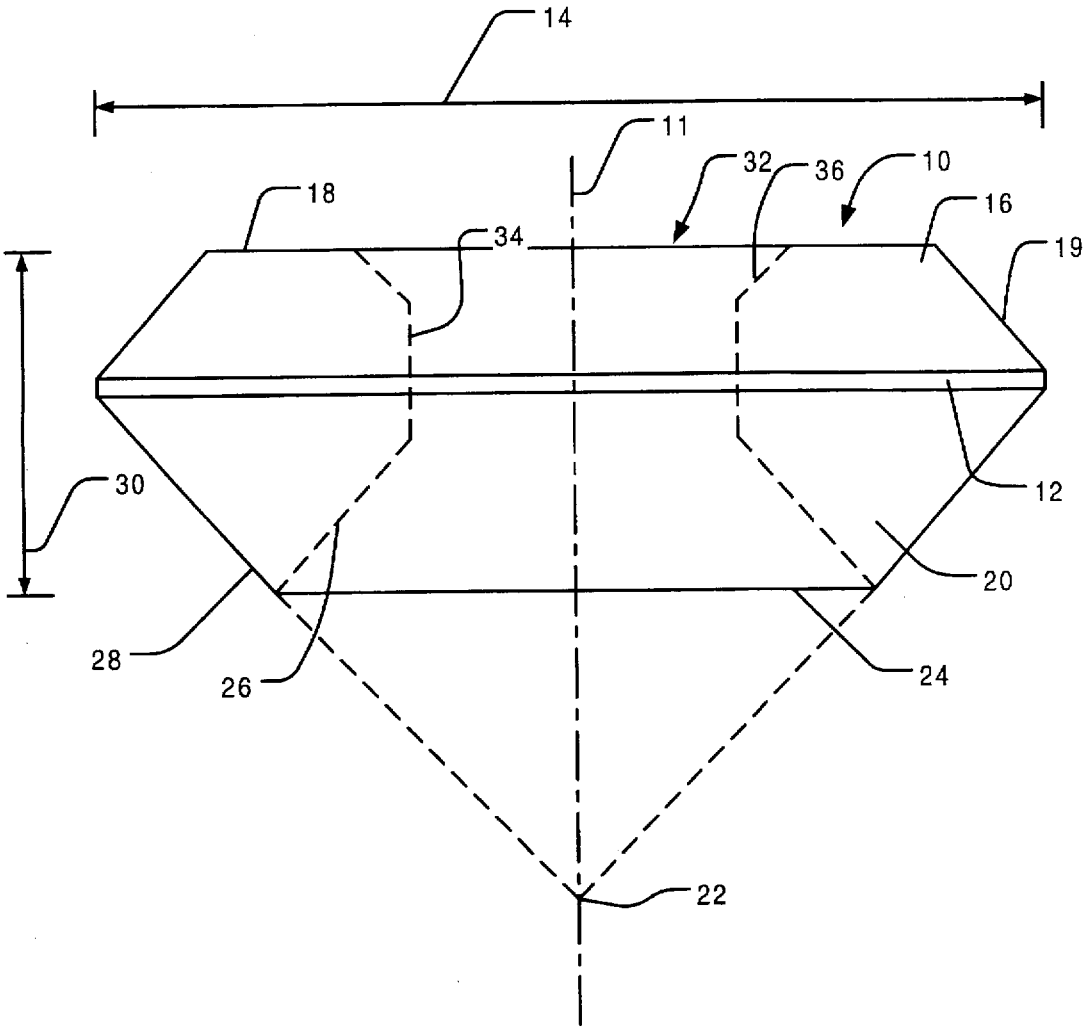
FIG. 1 is a side elevation view of a gemstone of the invention with a central bored hole shown in phantom.

The structure of gemstones cut in accordance with the invention will now be discussed with reference to FIG. 1. For purpose of illustration, a round gemstone 10 is shown. However, it should be understood that the invention can be applied various shapes such as oval, marquise, heart, pear, cushion, etc. Such cuts will be discussed further below. Line 11 represents the vertical axis of the gemstone 10, most stones being cut so that facets are disposed in a symmetrical pattern with respect to this axis. A girdle 12 lies along a girdle plane normal to the vertical axis 11 and has a thickness typically about 2% of the girdle diameter 14. A crown 16 is provided having a table 18 which is a flat area having a diameter which may range from about 60 to 98% of the girdle diameter. A main or outside crown angle 19 extends from the girdle 12 to the table 18.

Below the girdle 12 lies a pavilion 20 which for a conventional prior art gemstone would extend to a pointed tip 22, known as the culet. The portion of the pavilion 20 which is absent in the gemstones of the present invention is shown in phantom lines below the gemstone 10. With the gemstones of the invention, the need for much of the pavilion of conventional gemstones is eliminated allowing the use of gems with a much shallower depth. With a conventional gemstone cut, the girdle diameter would have to be reduced to provide the proper depth to girdle diameter ratio. A conical indentation is formed in the pavilion 20 providing an inside pavilion face 26. A culet ring 24 is created lying in a plane parallel to the girdle plane. The pavilion 20 further includes an outside pavilion face 28 which may be faceted or smooth. The overall depth 30 of gemstone 10 is substantially less than a conventionally-cut gemstone having the same girdle diameter. As noted above, the depth of the pavilion in a conventionally-cut stone is quite considerable, being about 50% of the girdle diameter. However, many valuable gemstones are found which are too shallow to accommodate the full depth of a conventional pavilion. The present invention substantially increases the value of such gemstones.

The gemstone 10 includes a center bored hole 32 centered on vertical axis 11 and extending from the table 18 to the inner pavilion face 26. An inside girdle 34 surrounds the central bored hole 32 and connects to the table 18 with an inside crown angle 36.

Figure 2:
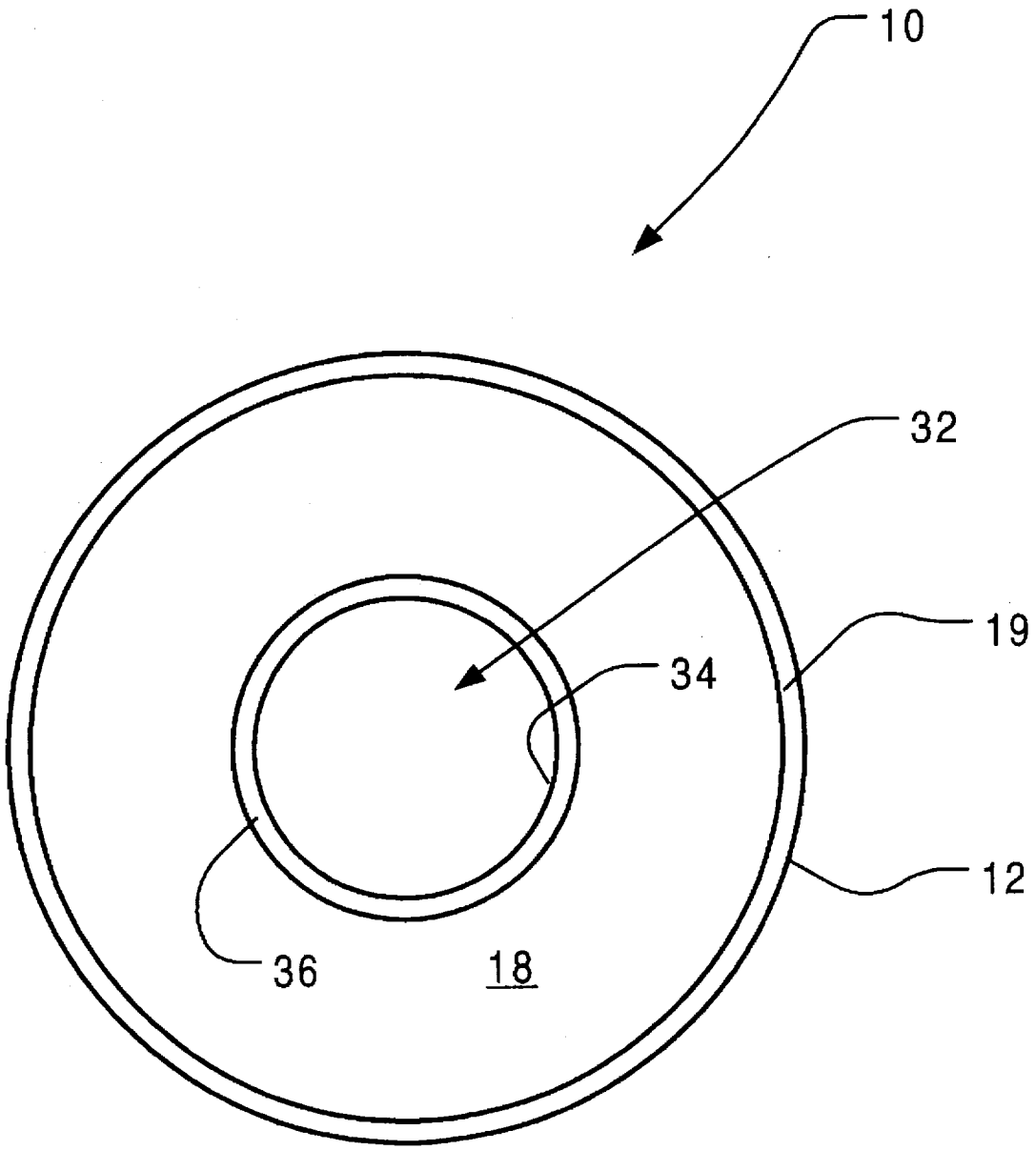
FIG. 2 is a top plan view of a round gemstone cut in accordance with the invention.

Referring now to FIG. 2, which shows a top plan view of gemstone 10, the torus or doughnut shape of the gemstone can be seen. In the center of table 18, the inside crown angle 36 slopes to the center bored hole 32 which is surrounded by inside girdle 34. Surrounding the table 18 is the outside crown angle 19 which slopes out to the girdle 12. If desired, a smaller gemstone can be set within the center bored hole 32 using goldsmithing and/or lapidary techniques.

Figure 3:
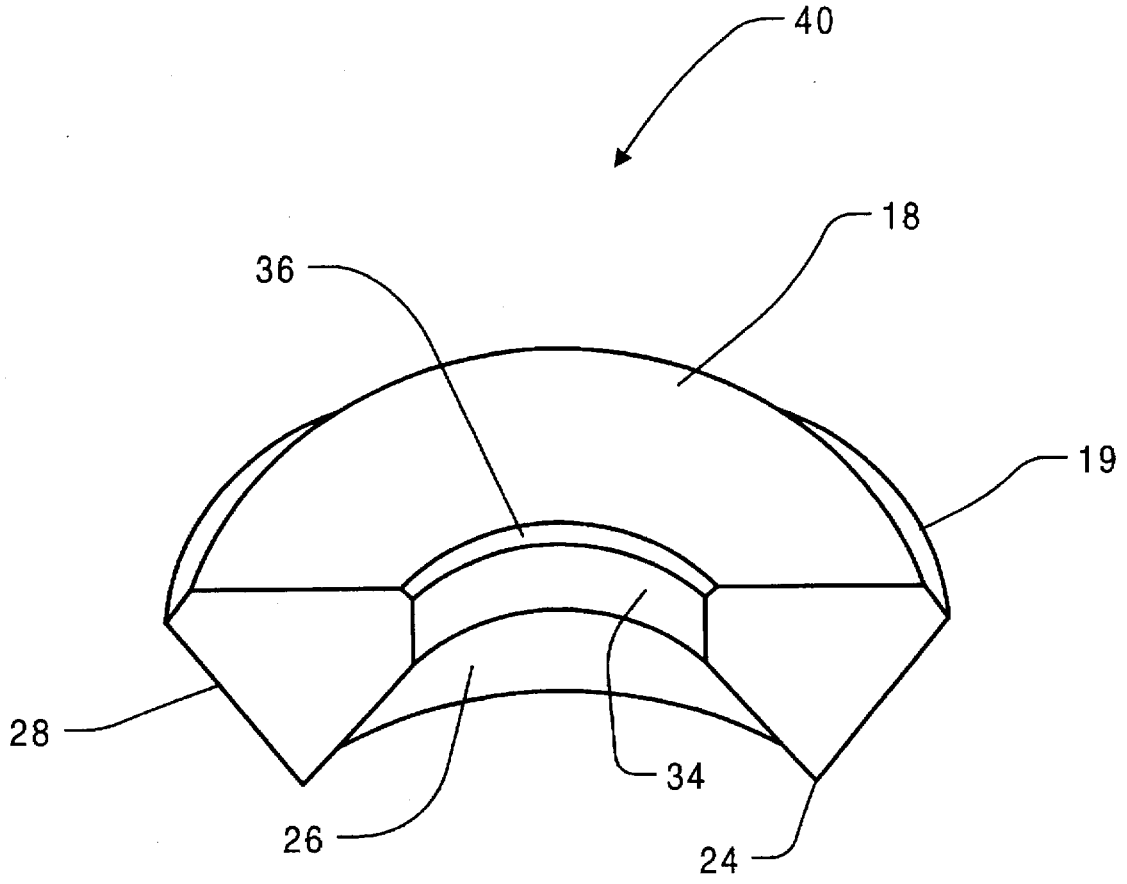
FIG. 3 is a perspective view of a half-round gemstone of the invention.

An alternative embodiment of the invention is shown in FIG. 3. A half round gemstone 40 is shown in perspective view. It includes each of the elements of the torus ring cut but has been cut into a section of a whole. Thus it includes a table 18, inner crown angle 36, outer crown angle 19, inner girdle 34, inside pavilion face 26, outside pavilion face 28 and culet ring 24. The culet ring 24 is actually a portion of a ring for such toroidal portion shapes. Other sectioned cuts such as three-quarters, nine-tenths, etc. can also be provided. Additionally, the sectioned cuts are not limited to round shapes but can be cut from any fancy cut gem profile such as oval, marquise, heart, pear, cushion, etc.

Figure 4:
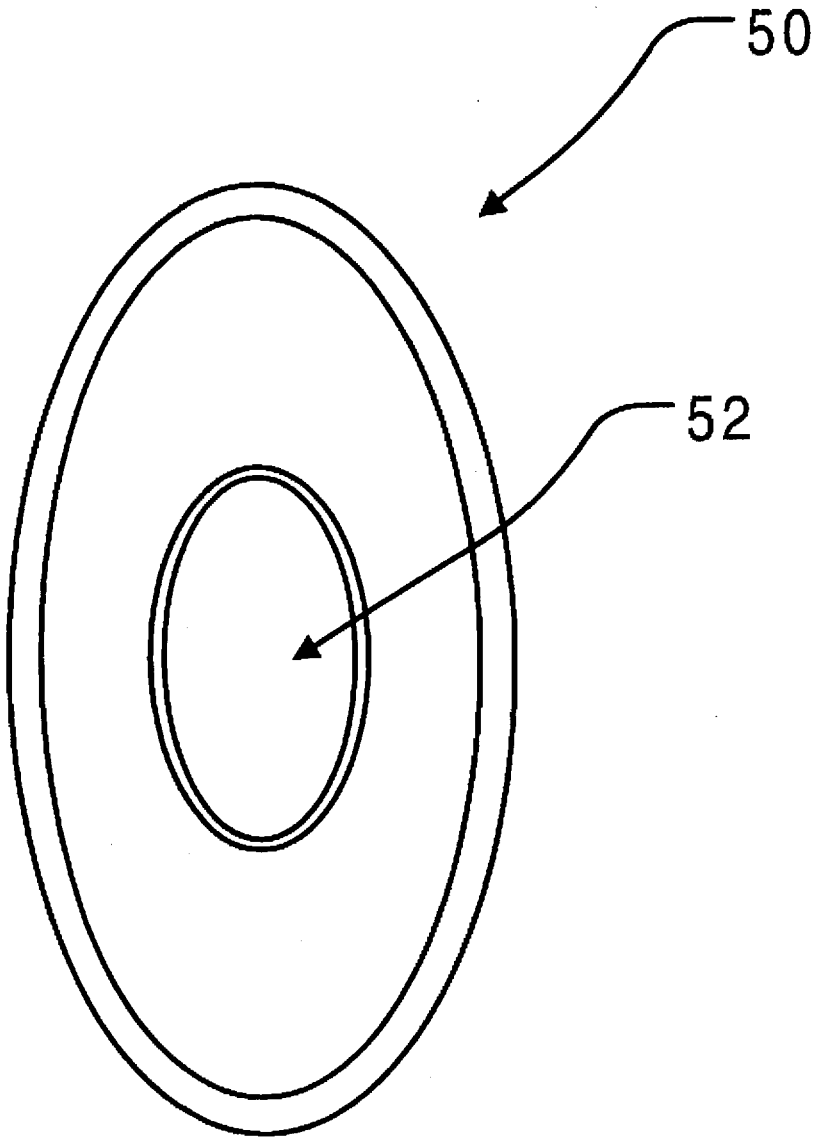
FIG. 4 is a top plan view of an oval gemstone of the invention having an oval central bored hole.

Referring now to FIG. 4 a top plan view of an oval gemstone 50 cut in accordance with the invention is shown. Gemstone 50 includes central hole 52 having an oval shape. It is actually preferred to use a round bored hole calibrated to the overall stone diameter if the depth of the stone is sufficient. However, for shallow gemstone material, a hole outlining the outside girdle diameter can be used. With the example of the oval central hole, the hole can be created by hand carving or a milling process. Such fancy cut stones can present a problem with the angle of the inside pavilion face. Using the oval gemstone 50 as the example, the inside pavilion face that stretches toward narrow ends of the oval (where the oval has its maximum diameter) may need to be cut shallower than the critical angle of reflection (depending on the gem material critical angle typically ranging between about 39 and 42 degrees). However, as the inside pavilion face angle curves around towards the narrower diameter of the gemstone, the inside pavilion face angle can be sloped back up to and above the critical angle of the gemstone material. If cut properly, very little loss of reflection will occur.

As an example of the benefit of the gemstone cut of the present invention, one can consider a 15.0 mm standard round brilliant gemstone. Such a gemstone would require an overall depth of 9.0 mm to achieve the preferred refractive brilliance with a conventional cut. In contrast, a torus cut of the invention can achieve full refractive brilliance with a depth of no more than 3.3 to 5.7 mm (22–38%). An even shallower cut is possible with a larger diameter center bored hole. The ability to provide a full diameter shallow cut allows the gemstone to sit much lower to the body of the wearer and to achieve greater gemstone weight retention after cutting.

Figure 5:
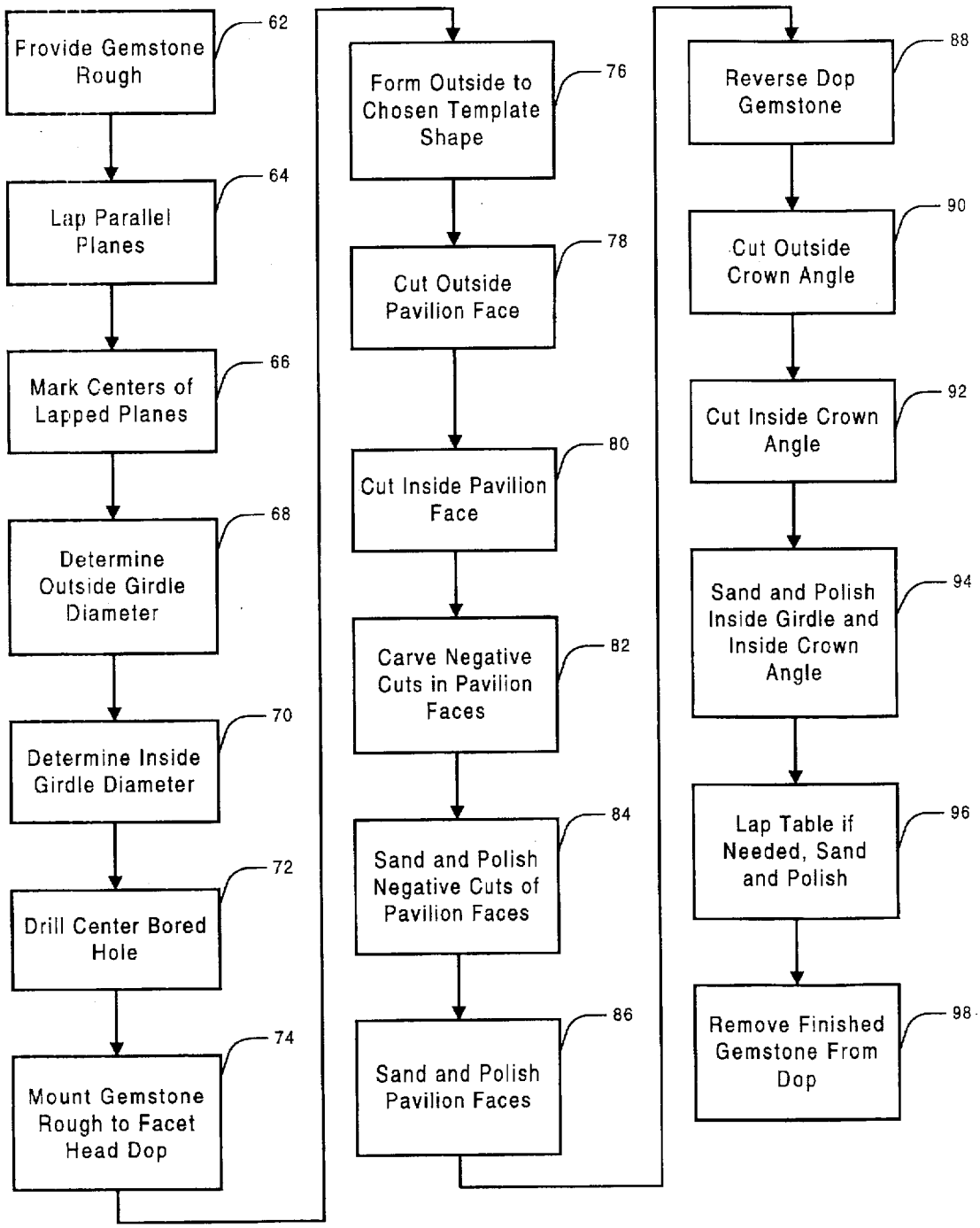
FIG. 5 is a flowchart illustrating the method of the invention.

The method for producing the gemstones of the invention will now be discussed with reference to the process flowchart of FIG. 5. It should be understood that both laboratory grown or synthetic gemstone material and natural gemstone material may be used. Further, the production may be done primarily by hand or by a combination of automated steps by computer numerical control (CNC) machining and finishing by hand using tools known in the art of carving and cutting of gemstones.

The process begins at step 62 by providing a gemstone rough, either synthetic or natural, of the desired material. As is known in the art, the different gemstone materials have different indices of refraction which determines the critical angle for reflection and thus the desired pavilion angles. At a step 64, parallel planes are lapped to the gemstone rough. This step can be done by hand and a micrometer or with a standard faceting machine. The tolerance of the two planes for parallel is preferably ±0.05 mm. This tolerance is critical in order for the center bored hole 32 to intersect perpendicular to the parallel planes which will be cut to form the table 18 and the culet ring 24.

A next step 66 involves marking the centers of the lapped planes. This can be done by drawing perpendicular cross hairs on the planes using ink. With a template of the appropriate shape, i.e., round, oval, marquise, cushion, etc., the girdle diameter 14 is determined at step 68 for maximum weight retention or if cutting for calibration. This establishes the future girdle profile of the finished gemstone. The relevant factors considered by the gemcutter in achieving maximum weight retention include deciding the optimal shape (round, marquise, etc.) for an individual gemstone rough, the girdle diameter to depth ratio, and/or the presence of any undesirable flaws or inclusions in the gemstone rough. With regard to calibration cutting, it is an issue of finding the right gemstone rough to fit the required shape and size. It is understood when calibrating gemstones that one will lose more weight from the rough but will gain regularity and consistency of size. This requirement is needed for mass production in the manufacturing of gemstone jewelry.

After the outside diameter is determined, the diameter of the center bored hole 32 is determined at step 70. This is calculated from the depth of the stone relative to the outside girdle diameter in order to achieve desired brilliance based on the critical angle for the gemstone material. Thus, the diameter of the hole can be based on a chosen angle for the inside pavilion face 26 which should be at least the critical angle or greater. The selection of the hole diameter and angle for the inside pavilion face results in a height for the inside pavilion face 26, i.e., the vertical distance from the plane of the culet ring 24 to the intersection of the inside pavilion face 26 with the inside girdle 34, being from about 20 to 90% of the depth 30.

Table 1 provides three examples of various configurations of round gemstones having a given outside girdle diameter and different depths with a fixed outside pavilion face angle.

TABLE 1

| Gemstone | #1 | #2 | #3 |
|---|---|---|---|
| Outside Girdle Diameter | 16.0 mm | 16.0 mm | 16.0 mm |
| Depth | 6.7 mm | 5.4 mm | 4.8 mm |
| Inside Girdle Diameter | 4.4 mm | 3.3 mm | 4.5 mm |
| Inside Pavilion Face Angle | 53° | 45° | 58° |
| Outside Pavilion Face Angle | 53° | 53° | 53° |

Once the outside diameter, inside diameter and overall depth have been determined for the lapped rough, the center bored hole 32 can be drilled at step 72. When cutting by hand, the gem rough is mounted in a drill press and the bored hole is diamond core drilled. The hole can alternatively be drilled using a CNC milling machine, in which case several pieces can be drilled at once, preferably using a diamond core drill attachment with center coolant feed.

After the center bored hole 32 is drilled, the gemstone rough is mounted to a facet head dop at step 74. A special dop is used having the correct hole diameter with a slightly larger step ledge to match the hole in the gemstone rough. This type of dop assures that the drilled gemstone rough is dopped to dead center of the center bored hole. The gemstone is mounted by inserting the dop inside the hole and adhering by a UV type glue, super glue, facetor's dop wax or other such material as is known in the art. This mounting is temporary and will later be removed.

The dop with the gemstone mounted thereon is itself mounted in a faceting machine and set to a 90 degree angle to the lapped parallel planes. The outside girdle 12 is now formed at step 76 to the chosen template shape using a matching cam which is mounted to the reverse end of the faceting head. At this point the outside diameter and shape of the gemstone is complete.

Once the girdle is complete, the outside pavilion face 28 is cut on the curved round at step 78. This is done to the carver's preference such as faceting flat planes of assorted angles. In a preferred embodiment, the angle is cut on a curved single smooth round surface forming a portion of a cone. The facet head is set to a predetermined angle in the range of about 45 to 58 degrees for the outside pavilion angle. The angle set depends on a number of factors. These include the relative dimensions of the depth to width to inside hole diameter, type of gemstone material and its refractive index, and whether the gem is light or dark. The refractive index determines the critical angle and the depth to width to inside hole diameter determine the actual range of angles possible for the gemstone. The darkness of the stone determines how much light can pass through it. The lighter the gemstone, the deeper it can be cut and still maintain the desired brilliance. When the stone is turned to the set angle, the angle starts at the bottom of a girdle plane with the distance below the parallel lapped plane being the depth of the crown plus about 0.2 to 1.0 mm thickness for the girdle plane (depending on the gemstone size).

The inside pavilion face 26 is now carved by hand or, in the case of a round cut using a CNC milling machine at step 80. The desired angle is the same as the outside pavilion angle. The inside pavilion face 26 is carved using an assortment of custom diamond plated or sintered carving points having shapes such as straight cylinders of various diameters, tapered cylinders, and cones with specified angular taper. For fancy shape gemstones, the inside pavilion angle varies for different parts of the gem in order to meet the outside pavilion at the culet ring. For example, with a marquise cut, the angle on the sides along the length may be as great as about 55 to 70 degrees and only about 42 to 45 degrees towards the points of the marquise cut.

In a preferred embodiment, at step 82 the inside and outside pavilion faces 26, 28 are carved with various negative cuts achieved using known gemstone carving techniques. A particular design carved on the inside pavilion face will be magnified and reflected on the outside pavilion face. Conversely, a design carved on the outside pavilion face will be reduced and reflected on the inside pavilion face.

The negative cuts of the pavilion faces are now sanded and taken to polish at step 84 using conventional techniques for the given gemstone material. This procedure can be accomplished either by hand or using a milling machine. Once the negative cuts have been sanded and polished, the inside and outside pavilion faces 26, 28 are sanded and polished at step 86 using the same techniques.

The gemstone is next reverse dopped with the crown up at step 88. A transfer dop is used for this step to maintain the girdle plane perpendicular to the dop direction. The outside crown angle 19 can now be cut either by hand or by cam on a faceting machine at step 90. The angle can vary from about 20 to 60 degrees depending on the available crown height and the desired design.

The inside crown angle 36 is now cut at step 92 by hand carving at approximately 45 degrees. The inside girdle 34 and inside crown angle 36 are now sanded and polished at step 94. If any negative cuts have been made in the table, they are also sanded and polished. The table is checked to determine if it is parallel with the girdle plane and if not, it is lapped, sanded and polished at step 96. The finished gemstone is then removed from the dop at step 98.

It should be understood that various alternatives to the embodiments of the invention described herein may be employed in practicing the invention. For example, the invention may be practiced by cutting and carving techniques other than the procedures set forth in this specification. Further, the details of the facet design which may be cut on the outer and inner surfaces of the crown and pavilion may vary greatly depending on individual preference. It is thus intended that the claims define the scope of the invention and that structures and methods within the scope of these claims and their equivalents be covered thereby.

What is claimed is:

1. A torus ring gemstone comprising:

a crown having a planar table;

a pavilion extending below said crown;

a planar girdle between said crown and said pavilion, said girdle being substantially parallel to said table; and said crown, girdle and pavilion including a hole extending from said table through said crown, girdle and pavilion, said hole having an axis substantially perpendicular to said table.

2. The gemstone of claim 1 wherein said pavilion includes an outside pavilion face angled from said girdle toward said axis and an inside pavilion face angled from said hole outward toward said outside pavilion face.

3. The gemstone of claim 2 wherein an angle between said inside pavilion face and said axis varies from one portion of said inside pavilion face to another portion of said inside pavilion face.

4. The gemstone of claim 2 wherein selected ones of said inside pavilion face, outside pavilion face and table include negative cuts.

5. A gemstone comprising:

a crown, a pavilion and a girdle, said crown including a planar table at an upper portion thereof;

said crown and said pavilion including a hole centered on a vertical axis of said gemstone and extending from said table through said crown and said pavilion; and said pavilion including an inside pavilion face angled away from said hole and an outside pavilion face angled inward toward said axis and intersecting said inside pavilion face at a ring culet.

6. The gemstone of claim 5 wherein said gemstone has a critical angle and wherein:

an angle between said inside pavilion face and said axis is selected to be greater than said critical angle; and an angle between said outside pavilion face and said axis is selected to be greater than said critical angle.

7. The gemstone of claim 5 and further including a second smaller gemstone set within said hole in said crown.

8. The gemstone of claim 5 wherein said gemstone has a general shape selected from the shapes of round, oval, marquise, heart, pear and cushion.

9. The gemstone of claim 5 wherein said gemstone has the general shape of a torus ring with a portion of said ring removed.

10. A gemstone comprising:

a crown having a table;

a pavilion;

a girdle between said pavilion and said crown;

said pavilion including a conical depression centered on a vertical axis of said gemstone; and said crown, pavilion and girdle including a hole therethrough centered on said vertical axis and extending from said table through said pavilion.

11. The gemstone of claim 10 wherein said conical depression in said pavilion forms an inside pavilion face angled outward from said vertical axis and said pavilion further includes an outside pavilion face angled inward from said girdle toward said vertical axis.

12. The gemstone of claim 11 wherein said hole has a circular cross-section.

13. The gemstone of claim 11 wherein said hole has a non-circular cross-section.

14. The gemstone of claim 10 wherein said pavilion includes an inside pavilion face angled away from said hole and an outside pavilion face angled inward toward said axis and intersecting said inside pavilion face at a ring culet.

15. A method for carving a gemstone comprising the steps of:

forming first and second substantially parallel planes on a gemstone rough;

drilling a hole through said gemstone, said hole having an axis perpendicular to said first and second parallel planes;

forming a periphery of said gemstone to a selected shape; and cutting inside and outside pavilion faces on a lower portion of said gemstone, said faces intersecting at a ring culet.

16. The method of claim 15 wherein said step of forming a periphery of said gemstone includes forming a girdle on said gemstone between and substantially parallel to said first and second parallel planes, said girdle separating said gemstone into a crown between said girdle and said first parallel plane and a pavilion between said girdle and said second parallel plane.

17. The method of claim 16 and further including the step of forming a crown angle on said crown of said gemstone between said girdle and said first parallel plane thereby forming a table at said first parallel plane.

18. The method of claim 17 and further including the step of forming an inside crown angle between said table and said hole, a periphery of said hole between said inside crown angle and said inside pavilion face providing an inside girdle.

19. The method of claim 18 and further including the steps of sanding and polishing selected ones of said inside pavilion face, outside pavilion face, inside girdle, outside crown angle, inside crown angle and table.

20. The method of claim 15 and further including the steps of carving, sanding and polishing negative cuts in selected ones of said inside pavilion face, outside pavilion face and first parallel plane.

* * * * *